US008293028B2

(12) United States Patent
Hammond et al.

(10) Patent No.: US 8,293,028 B2
(45) Date of Patent: Oct. 23, 2012

(54) METHOD FOR CARBURIZING STEEL COMPONENTS

(75) Inventors: Stephen N. Hammond, Brownsburg, IN (US); Udayan Trivedi, Indianapolis, IN (US); Thomas L. Doubts, Heber City, UT (US); Douglas C. Steckbauer, Park City, UT (US)

(73) Assignee: Rolls-Royce Corporation, Indianapolis, IN (US)

( * ) Notice: Subject to any disclaimer, the term of this patent is extended or adjusted under 35 U.S.C. 154(b) by 0 days.

(21) Appl. No.: 12/689,478

(22) Filed: Jan. 19, 2010

(65) Prior Publication Data

US 2011/0017350 A1 Jan. 27, 2011

Related U.S. Application Data

(60) Continuation of application No. 11/787,839, filed on Apr. 18, 2007, now Pat. No. 7,648,588, which is a division of application No. 10/765,300, filed on Jan. 27, 2004, now Pat. No. 7,208,052.

(60) Provisional application No. 60/531,831, filed on Dec. 23, 2003.

(51) Int. Cl.
*C23C 8/22* (2006.01)

(52) U.S. Cl. ..... 148/225; 148/233; 148/223; 148/319

(58) Field of Classification Search ..... 148/225, 148/233, 223, 319
See application file for complete search history.

(56) References Cited

U.S. PATENT DOCUMENTS

| | | | | |
|---|---|---|---|---|
| 5,000,368 | A * | 3/1991 | Turner | 228/131 |
| 5,531,836 | A * | 7/1996 | Dezzani et al. | 148/233 |
| 6,218,642 | B1 * | 4/2001 | Christmas et al. | 219/121.66 |
| 2006/0090817 | A1 * | 5/2006 | Somers et al. | 148/218 |

OTHER PUBLICATIONS

U.S. Appl. No. 60/401,215 (2002).*
ASM International, Material Park, Ohio, Properties and Selection: Irons, Steels, and High Performance Alloys, "Wrought Stainless Steels", Mar. 1990, vol. 1, pp. 841-842.*
ASM International, Material Park, Ohio, Heat Treating, "Gas Carburizing", Aug. 1991, vol. 4, pp. 312-324.*
ASM International, Material Park, Ohio, Heat Treating, "Microstructures and Properties of Carburized Steels", Aug. 1991, vol. 4, pp. 363-375.*
ASM International, Material Park, Ohio, Heat Treating, "Stess Relief Heat Treating of Steel", Aug. 1991, vol. 4, pp. 33-34.*
ASM International, Material Park, Ohio, Heat Treating, "Introduction to Surface Hardening of Steels", Aug. 1991, vol. 4, pp. 259-267.*
ASM International, Material Park, Ohio, Heat Treating, "Introduction to Heat Treating of Tool Steels", Aug. 1991, vol. 4, pp. 711-725.*
ASM International, Material Park, Ohio, Heat Treating, "Vacuum Carburizing", Aug. 1991, vol. 4, pp. 348-351.*

* cited by examiner

*Primary Examiner* — Jessee R. Roe
(74) *Attorney, Agent, or Firm* — Krieg DeVault LLP

(57) ABSTRACT

A carburizing process for increasing the hardness of a case region of a steel component. In one form the application includes plating the outer surface of a stainless steel component with nickel prior to carburizing. One component includes a stainless steel object having a hardened case substantially free of continuous phase grain boundary carbides.

19 Claims, 6 Drawing Sheets

METHOD FOR CARBURIZING STEEL COMPONENTS

CROSS REFERENCE TO RELATED APPLICATIONS

The present application is a continuation of U.S. patent application Ser. No. 11/787,839 filed on Apr. 18, 2007, now U.S. Pat. No. 7,648,588 which is a divisional of U.S. patent application Ser. No. 10/765,300 filed Jan. 27, 2004, now U.S. Pat. No. 7,208,052, which claims the benefit of U.S. Provisional Patent Application 60/531,831 filed Dec. 23, 2003, each of which is incorporated herein by reference.

BACKGROUND OF THE INVENTION

The present invention relates generally to a process for carburizing a steel component to increase the surface hardness of the material. More particularly, in one form the present inventive process includes electroless nickel plating the outer surface of a martensitic stainless steel component prior to vacuum carburizing. Although the present invention was developed for processing components formed of stainless steel, certain applications extend outside of this field.

In the design and manufacture of steel components, there is often a need to modify properties of the material. It is well recognized that carburizing is a process suited for hardening the surface and sub-surface of the steel component. Carburizing can be broadly considered as either an atmospheric carburization process or a vacuum carburization process. In the vacuum carburization process, the component is heated to an elevated temperature within a carburizing furnace, and a carburizing gas is introduced into the environment so that carbon atoms are diffused into the surface and sub-surface of the steel material. The carbon content in the surface and near sub-surface of the component is increased while the carbon content within the core of the component remains unaltered. The characteristics of the component have thus been modified to provide a hardened outer surface surrounding an interior core.

In response to the continued demand for new goods and services, engineers and scientists are always seeking to enhance products through material selection and/or process development. Stainless steel is widely utilized in many components in a vast array of products. One stainless steel of interest is available under the tradename, Pyrowear 675. A known technique associated with carburizing the Pyrowear 675 component is to oxidize the surface of the component prior to exposure to the carburizing environment. The component is grit blasted and placed in an air furnace at a temperature of 1800° F. for about one hour to form an oxide on its surface. Upon the component being subjected to the carburizing environment, the oxidized surface facilitates the absorption of carbon by the material.

In a carburizing process the time and temperature that the material is subjected to while in the carburizing environment will determine the surface hardness, case depth, hardness profile, and carbide microstructure of the hardened portion of the material. In the prior method discussed above, after carburization the Pyrowear 675 material is annealed, hardened, annealed, hardened, stabilized in a deep freeze, tempered, brought to room temperature, and then tempered again. With reference to FIG. 1, there is illustrated a prior heat treat cycle for carburizing and hardening the Pyrowear 675 material. Further, with reference to FIG. 2, there is illustrated a hardness profile for a carburized Pyrowear 675 component that was processed with the heat treat cycle set forth in FIG. 1.

While there are many prior processes for carburizing steel components, there remains a need for additional development in this area. In furtherance of this need, the present invention provides a novel and non-obvious means for carburizing steel.

SUMMARY OF THE INVENTION

One form of the present invention contemplates a method of increasing the hardness of a steel object. The method comprising: applying a nickel plating to at least a portion of a surface of the steel object; subjecting the steel object to carburizing to allow carbon atoms to diffuse through the nickel plating and form a case portion at a depth greater than or equal to 0.012 inches; and heat treating the steel object after said subjecting and the case portion having a hardness of at least Rc 50.

Another form of the present invention contemplates a method of processing a steel object, comprising: plating a surface of the steel object with an electroless nickel material; heating the steel object to a carburizing temperature; subjecting the steel object to carburizing wherein carbon atoms diffuse through the plating and form a hardened case region; and removing at least a portion of the electroless nickel material after said subjecting.

Another form of the present invention contemplates a method comprising: (a) applying an electroless nickel plating to a surface on a stainless steel object; (b) placing the object within a mechanical housing; (c) evacuating the environment within the mechanical housing to a sub-atmospheric pressure; (d) heating the object within the mechanical housing to a carburizing temperature; (e) introducing a carburizing gas into the mechanical housing for a first period of time; (f) drawing a vacuum within the mechanical housing for a second period of time; and (g) repeating acts (c)-(f) a plurality of times.

Yet another form of the present invention contemplates an apparatus comprising: a steel body having a hardened carburized ease portion and a core portion, wherein said case portion has a hardness of at least Rc 50 and is substantially free of continuous phase grain boundary carbides.

Yet another faun of the present invention contemplates an apparatus comprising: a stainless steel body having a hardened carburized case having a depth greater than or equal to 0.012 inches and a hardness greater than Rc 60.

One form of the present invention contemplates a unique process for carburizing a steel component.

Related objects and advantages of the present invention will be apparent from the following description.

DESCRIPTION OF THE PREFERRED EMBODIMENTS

Figure 1:
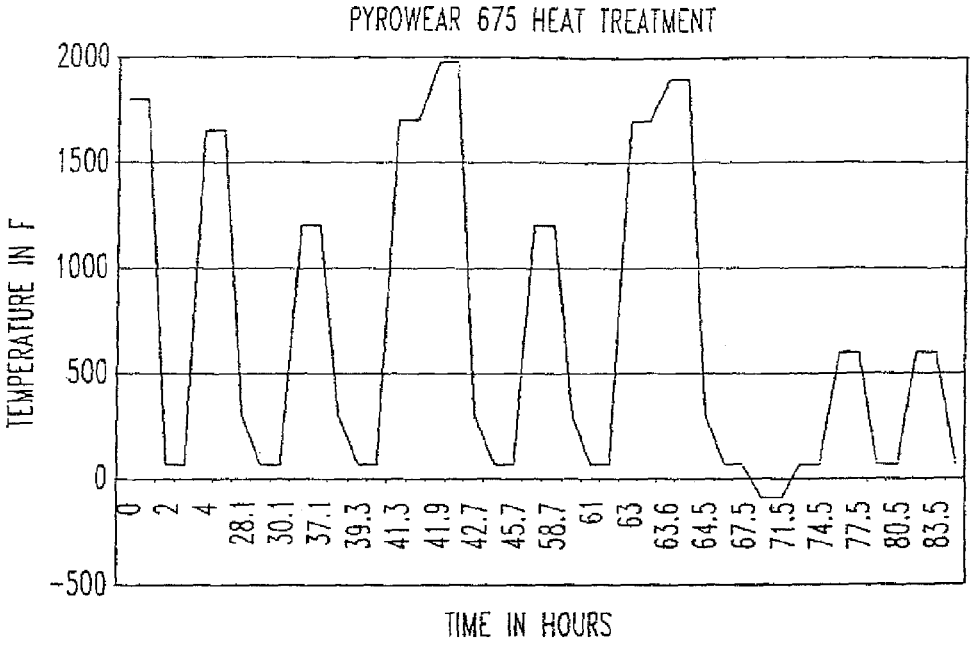
FIG. 1 is a time-temperature plot illustrating a prior heat treat cycle for carburizing and hardening Pyrowear 675.

For purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Steels can be carburized and hardened to achieve a case with a hardness higher than the core. When a steel containing chromium is carburized, the carbon can unite with the chromium and form a chromium carbide. Different forms of chromium carbide go into solution at different temperatures. The chromium carbides can participate out at the iron grain boundaries and form a continuous phase along iron grain boundaries. This network will weaken the material in the case because the continuous phase along the grain boundaries will make it brittle and more easily cracked than if this continuous phase did not exist. If chromium carbides are small and uniformly dispersed within the iron the material is not mechanically degraded and may have enhanced wear resistance.

Figure 2:
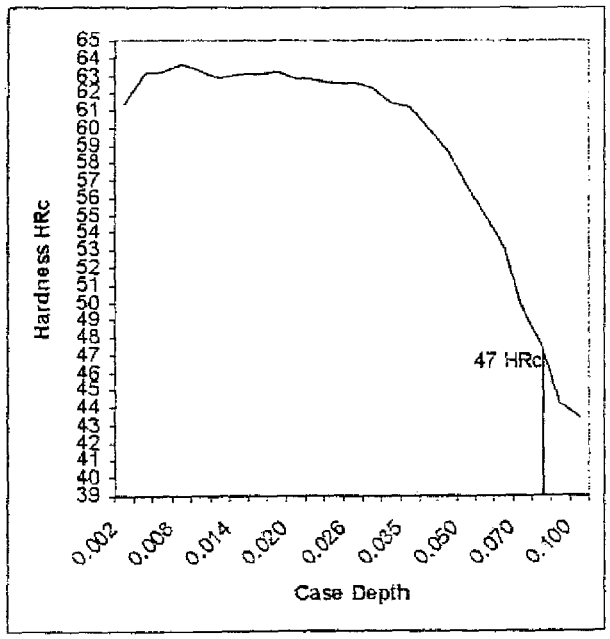
FIG. 2 illustrates a hardness profile of a Pyrowear 675 component that has been carburized and heat treated by the heat treat cycle set forth in FIG. 1.
Figure 2A:
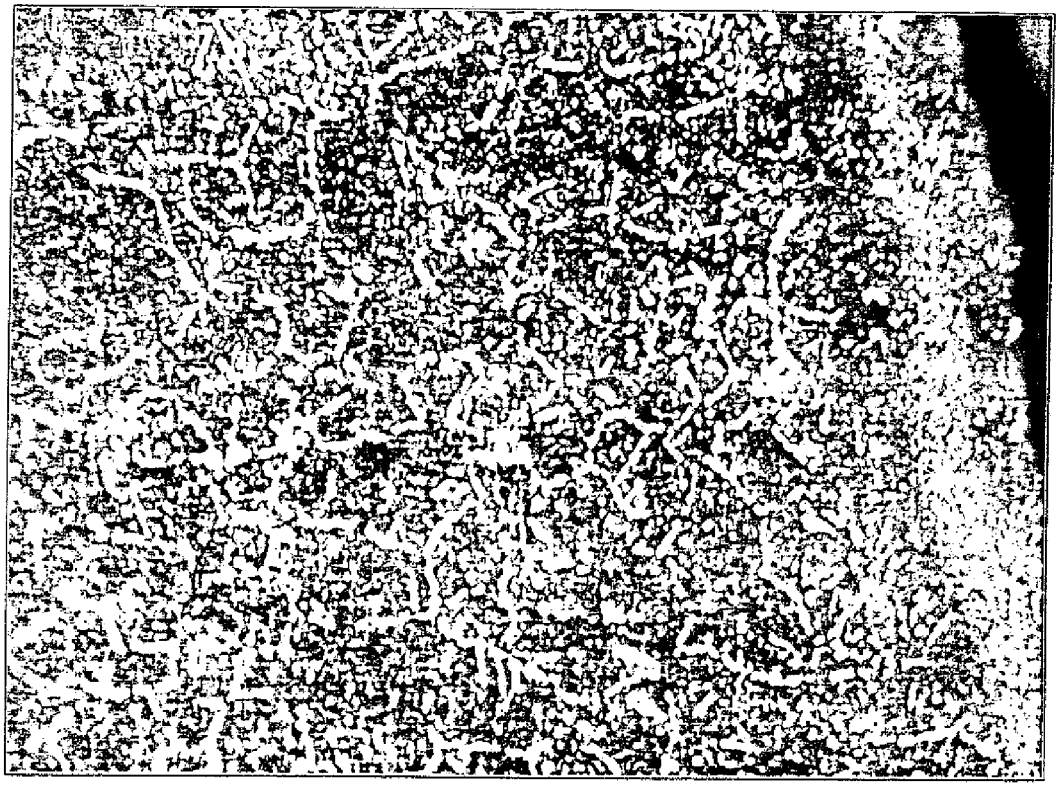
FIG. 2*a* is a micrograph illustrating the Pyrowear 675 carburized and hardened microstructure without using the nickel plating surface preparation prior to carburizing.

With reference to FIG. 2*a*, there is illustrated a micrograph showing one form of chromium carbides participated out at the grain boundaries in a large size and forming a continuous phase along the iron grain boundary in a piece of Pyrowear 675. The chromium carbides when formed in a large size and in a continuous phase along the grain boundaries of the iron depletes the iron matrix of chromium that was previously in solution in the iron. Without the original amount of chromium in solution in the iron, the steel's corrosion resistance is degraded. If fine uniformly distributed carbides exist, this condition has less effect upon the corrosion resistance of the steel than a condition of large carbides with a network in the iron's gain boundaries.

The inventors in the present application find that the carburizing of chromium containing steels with a nickel plating on the surface, facilitates the diffusion of carbon within the steel without forming large carbides nor a continuous phase of carbides along the grain boundaries. Further, the inventors in the present application have found that they can control the formation of carbides in a carburizing process by controlling the thickness of the nickel plating. In one application, the component is designed to have a case with substantially no carbides and a thinner nickel plating is utilized. In another application, it is desired to have fine uniformly dispersed carbides; then, a thicker nickel plating is utlized.

Figure 3:
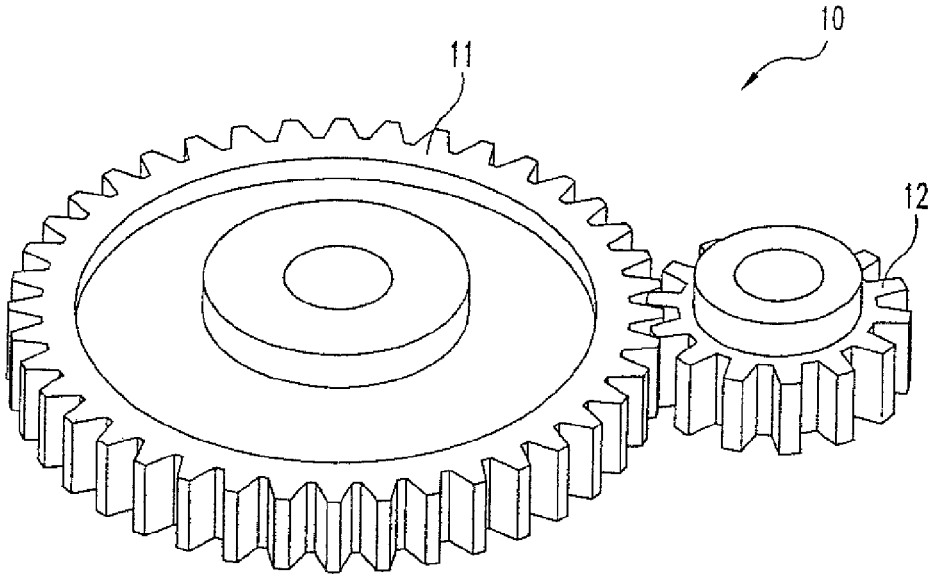
FIG. 3 is an illustration of a gear set.

With reference to FIG. 3, there is illustrated a gear set 10 including gear 11 and 12. The gear set 10 is purely illustrative, and is not intended to be limiting. The present invention contemplates a process that is applicable to use on any type of gear with no limitation intended based on the specific type of gear. As will be described in detail below, the present description will set forth a process for carburizing a component or portion of the component, such as but not limited to gears. The process can be utilized on a variety of types of materials, including but not limited to wrought materials. Conventional processes may thereafter machine the component. The machined component will have surfaces and regions below the surface that have a hardened case region. However, the present invention also contemplates that the component may also not be machined after the hardening techniques.

Figure 4:
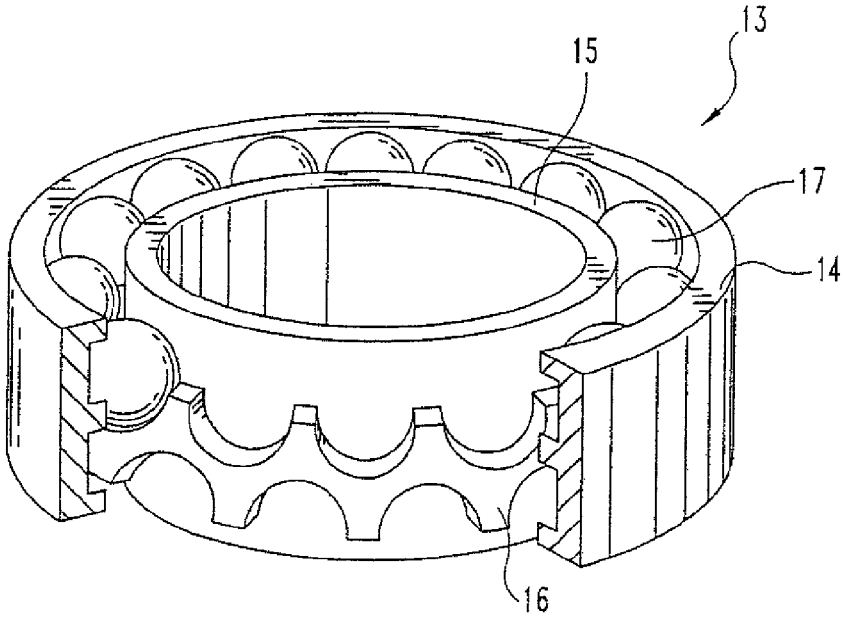
FIG. 4 is a partially fragmented view of a rolling element bearing.

Referring to FIG. 4, there is illustrated a rolling element bearing 13. The rolling element bearing 13 illustrated in FIG. 4 is a ball bearing type rolling element bearing; however, other types of rolling element bearing, including, but not limited to, roller and tapered roller bearings, are contemplated herein. Bearing 13 includes an outer bearing race 14, inner bearing race 15, a cage 16, and a plurality of ball bearings 17. The bearing 13 in FIG. 4 can be a hybrid or completely metallic system. In one form, bearing 13 is formed of a material that is compatible with the process for carburizing the entire component or portions of the component as set forth below. The present invention finds application with any type of part, component and/or article and is not limited in anyway to gears or bearings.

Figure 5:
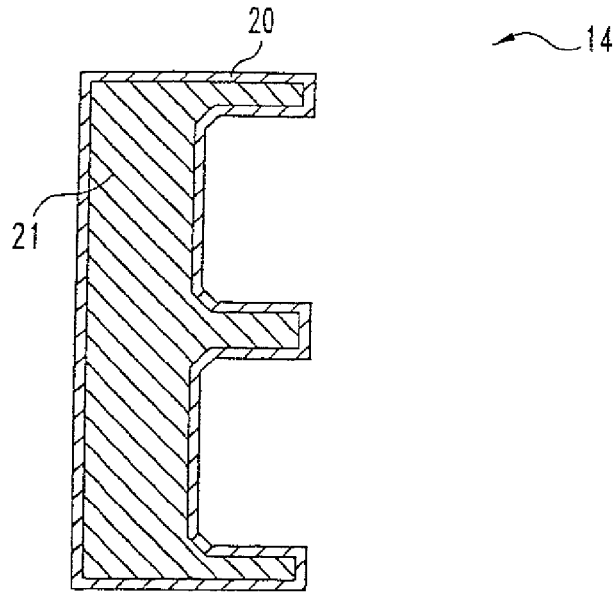
FIG. 5 is a cross-sectional view of an outer bearing race that has been processed by one form of the present invention.
Figure 6:
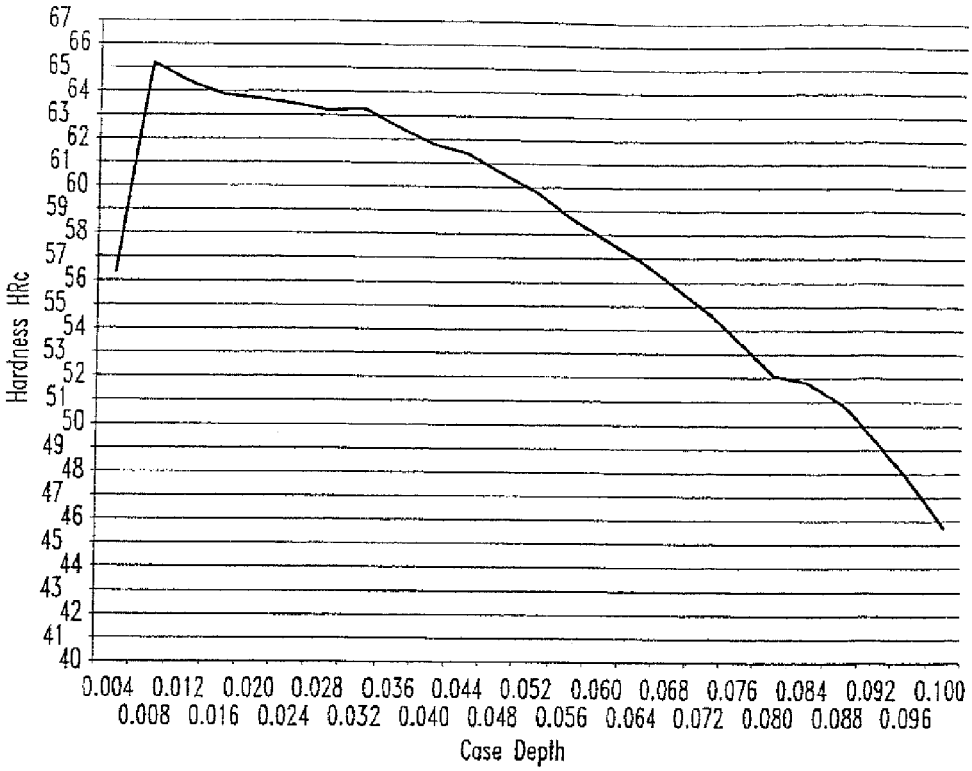
FIG. 6 is a plot illustrating hardness (HRC) versus case depth for a Pyrowear 675 component having a nickel plating thickness of 0.001 inches prior to carburizing.

With reference to FIG. 5, there is illustrated an enlarged cross-sectional view of the outer bearing race 14 that has been subjected to a carburizing process of the present invention. The outer bearing race 14 includes a case portion 20 and a core portion 21. The case portion 20 is formed by the carburizing process of the present invention and has hardness greater than that of the core portion 21. In one form of the present invention the case portion with hardness to at least HRc 50 extending to a depth greater than about 0.012 inches. In a preferred form the case portion has a hardness of at least HRc 50 in a case depth within a range of about 0.012 inches to about 0.090 inches below the surface of the component. The hardness within the case portion will decrease from the surface to the core. With reference to FIG. 6, there is illustrated a plot of hardness HRc vs. case depth for a Pyrowear 675 material that has been carburized and hardened utilizing one form of the present invention. However, the present application contemplates other case depths and harnesses and is not intended to be limited to the specific examples unless specifically stated to be limited thereto.

The present carburizing process is applicable for use on all stainless steel materials, including ferretic, martinsitic and austentic materials. Further, the present carburizing process is applicable to other types of steel materials, In a more preferred form of the present invention the material is a martinsitic stainless steel known by the tradename, Pyrowear 675. Pyrowear 675 is stainless steel having the following nominal chemical composition in weight percent: chromium (Cr) 13%; nickel (Ni) 2.85%; molybdenum (Mo) 1.8%; cobalt (Co) 5.3%; magnanese (Mn) 0.7%; vanadium (V) 0.6%; and the balance iron (Fe). While the preferred embodiments will be described with specific reference to articles made of stainless steel, such descriptions are exemplary in nature and should not be construed in a limiting sense unless specifically provided to the contrary.

The present method of forming a case portion in the component includes subjecting the outer surface of the component to a surface preparation act prior to subjecting the component to the carburizing environment. Carburization in general includes subjecting the component to an environment wherein carbon atoms can be diffused into the material through the outer surface of the component. Carburizing as utilized herein includes any type of carburization including but not limited to atmospheric and/or vacuum. In the present process nickel plating is deposited onto the external surface of the component prior to the component being subjected to the carburizing environment. The nickel plating can be applied by electroless nickel plating or an electroplating (galvanic) technique. The present process preferably utilizes the electroless nickel plating process, which is also known as chemical or auto-catalytic nickel plating. Electroless nickel plating is a process to deposit a deposition alloy of nickel based upon the catalytic reduction of nickel ions on the outer surface of the component. The component to receive the electroless nickel plate is soaked in a chemical nickel plating bath in order to receive a deposit of the nickel deposition alloy having a desired thickness onto the outer surface of the component. Chemical nickel plating baths are readily available from chemical supply houses, and one bath suitable for forming an electroless nickel deposition alloy coating on a component is sold by McDermit under the tradename NiClad 724. In one form of the present invention, the chemical nickel plating bath is run at a temperature of about 185° F. to about 190° F. It is understood that the present application is not limited to the particular chemical nickel plating bath and temperatures set forth herein and other chemical nickel plating baths and temperatures are contemplated herein.

Figure 5A:
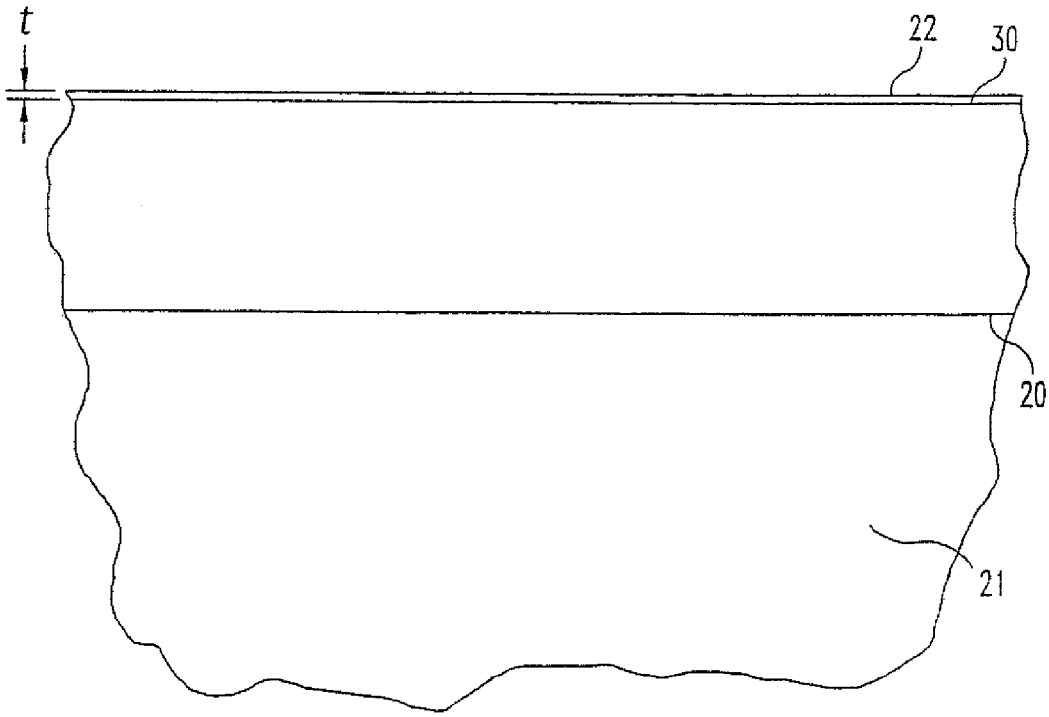
FIG. 5*a* is a schematic representation of the electroless nickel plating layer applied to the steel component.

With reference to the FIG. 5*a*, there is illustrated an illustrative portion of the component including the nickel plating layer 22, which has been deposited onto the surface 30 of the component. FIG. 5*a* also provides an illustration of the case portion 20 that will be formed during the carburizing phase of the present process. The drawing set forth in FIG. 5*a* is not drawn to scale and is provided to show the relative location of the nickel plating layer on the component. The thickness 't' of the electroless nickel plating layer 22 will depend on the deposition rate associated with the chemical nickel bath and the length of time that the component is subjected to the chemical bath. A property associated with electroless nickel plating is the ability to cover the surface with a uniform thickness of nickel deposition alloy. However, in one form of the present invention, a portion of the outer surface 30 has been masked/coated with a Paraffin material to prevent the deposition of the nickel alloy coating on this portion of the outer surface. The prevention of the nickel plating on the portion of outer surface 30 substantially eliminates the ability for case hardening to occur as desired by the present process.

In one form of the present invention, the desired electroless nickel plating is a deposition alloy of about 85 to 98 percent nickel (Ni) and about 2 to 15 percent phosphorous by weight percent. In a preferred form, the electroless nickel plating is a deposition alloy of about of about 92 to 98 percent nickel (Ni) and about 2 to 8 percent phosphorous by weight percent. In a more preferred form, the electroless nickel plating is a deposition alloy of about 96 to 98 percent nickel (Ni) and about 2 to 4 percent phosphorous by weight percent. In one form the electroless nickel plating has a thickness 't' within a range of about 0.0005 inches to about 0.0025 inches. More preferably, the thickness 't' is within a range of about 0.0005 inches to about 0.0015 inches. The Pyrowear 675 component that will be subjected to vacuum carburizing will preferably have a plating thickness 't' within a range of about 0.0005 inches to about 0.0015 inches. However, other nickel plating thickness 't' are contemplated herein.

The component having the nickel plating/coating is placed within a carburizing furnace and heated to the carburizing temperature. In one form of the present invention, the component formed of the stainless steel Pyrowear 675 is heated to a temperature within the range of about 1600° F. to about 1700° F., and more preferably to a temperature of about 1650° F. A deposition alloy having about 4 or less weight percent phosphorous has been found capable of withstanding the 1650° F. carburizing temperature without melting the plating.

As discussed above the present application contemplates the utilization of all types of carburization processes including but not limited to vacuum and/or atmospheric. The preferred carburizing process is a vacuum carburizing process in which the carburizing gas is introduced into the carburizing furnace to allow carbon atoms to diffuse through the outer surface of the component and develop the case portion. In one form the carburizing gas is defined by propane, however other carburizing gases are contemplated herein, including but not limited to Methane, Acetylene, and combinations of these gases. As will be understood by one of ordinary skill in the art, the length of time and the temperature at which the carbon atoms diffuse into the Pyrowear 675 will determine the surface hardness, case hardness profile, and carbide type, size and distribution in the case portion.

In one form the vacuum carburizing process includes the following cycle. The environment within the carburizing furnace was evacuated to a sub-atmospheric pressure. The temperature of the component is raised to the desired carburizing temperature by adding heat into the carburizing furnace and the temperature is maintained at the carburizing temperature during the carburizing process. Thereafter, carburizing gas is admitted into the chamber for a period of time. As the carburizing gas is being admitted into the carburizing furnace, a pump is operated to draw a further vacuum within the furnace. The drawing of the vacuum continues for a period of time and commences upon the introduction of carburizing gas into the furnace. Upon the completion of the predetermined time for drawing the vacuum with the pump the cycle is repeated a plurality of times. Upon the completion of the plurality of cycles forming the active carbon diffusion cycle, the process may then include a post carburizing passive diffusion time. In one form the post carburizing passive diffusion time occurs at the same temperature as the active carbon diffusion cycle but without the addition of any further carburizing gas. This post carburizing passive diffusion time will enable the carbon atoms to diffuse further into the material. Upon completion of the active carbon diffusion cycle or the post carburizing passive diffusion cycle the component is then cooled from the carburizing temperature rapidly by quenching in a quenching material. In one form the quenching material is selected from oil, water and an inert gas, however other quenching materials are contemplated herein. In another form of the present invention the component is cooled from the carburizing temperature by a slower cooling process.

The component is then subjected to post thermal cycles such as annealing, hardening, stabilizing and tempering. One form of the post thermal cycle will be described below. However, it should be understood that other post thermal cycles are contemplated herein. After carburizing, the carburized material is annealed at about 1200° F. for about 6 hours, then furnace cooled to below 200° F. This portion of the cycle places the steel in a softer condition suitable for a conventional machining operation. In one form of the present invention, after the annealing process at least a portion of the nickel plating is removed from the component prior to further acts to harden the component. In a preferred form of the present invention, after the annealing process the entire nickel plating is removed from the component prior to further acts to harden the component. Chemical means, mechanical process and/or grit blasting may remove the nickel plating.

The carburized and annealed material is then hardened at elevated temperatures from a range of about 1800° F. to about 1975° F. and held for about 40 minutes followed by rapid cooling such as an oil quench, water quench, or gas fan cooling. Hardening at these elevated temperatures puts carbides into solution in the iron. Upon rapid cooling some uniform carbides may participate out, however, the remaining carbon stays within the iron causing it to transform to a martensitic structure high in carbon and therefore high in hardness. After hardening the material a first time, the material can be annealed at about 1200° F. and slow cooled (furnace cooled) and then re-hardened a second time to achieve a more homogenous microstructure and a deeper case depth having a hardness of HRc 50. This second hardening may be desirable but is not always necessary and depends upon the design parameters including case depth and desired microstructure.

After the material is hardened, either single or double hardening, the material is cooled below room temperature, or stabilized. Within about one hour after reaching room temperature, the material is cooled to a temperature not warmer than about −90° F. and held at not warmer than about −90° F. for not less than about two hours. After this stabilization phase, the object is air warmed to room temperature. Upon completion of the stabilization process, the material is tempered. Within about one hour after reaching room temperature, the object is tempered by heating the object in a circulating air furnace maintained at about 600° F. for about two hours. In a preferred form, the temperature is maintained within a range of 600° F.±25° F. for two hours±fifteen minutes and then cooled to room temperature. The tempering cycle can be repeated once or a plurality of times as required obtaining specific material properties.

In one form of the present invention the stainless steel Pyrowear 675 component with an electroless nickel deposition alloy coating is placed within the vacuum carburizing furnace. A cycle within the furnace was run including the following. The environment within the carburizing furnace was evacuated to a sub-atmospheric pressure of about one torr. The furnace was heated to bring the temperature therein to a desired carburizing temperature. Thereafter, carburizing gas having a carbon content is admitted into the chamber for about one minute. As the carburizing gas is being admitted into the carburizing furnace, a pump is operated to draw a further vacuum within the furnace. The drawing down of the pressure within the furnace continues for a period of four minutes as measured from when the carburizing gas began entering into the furnace. Upon the completion of the predetermined time of four minutes for drawing down the pressure within the furnace the cycle is terminated. This cycle is repeated 520 times during the active carbon diffusion cycle. Upon completion of the active carbon diffusion cycle, the component undergoes a post carburizing passive diffusion time. The post carburizing passive diffusion time occurs at the same temperature as the active carbon diffusion cycle but without the addition of any further carburizing gas into the furnace. Thereafter, upon completion of the post carburizing passive diffusion cycle the component is cooled from the carburizing temperature rapidly by quenching in oil heated to 140° F. The component is then subjected to an annealing process.

Figure 7:
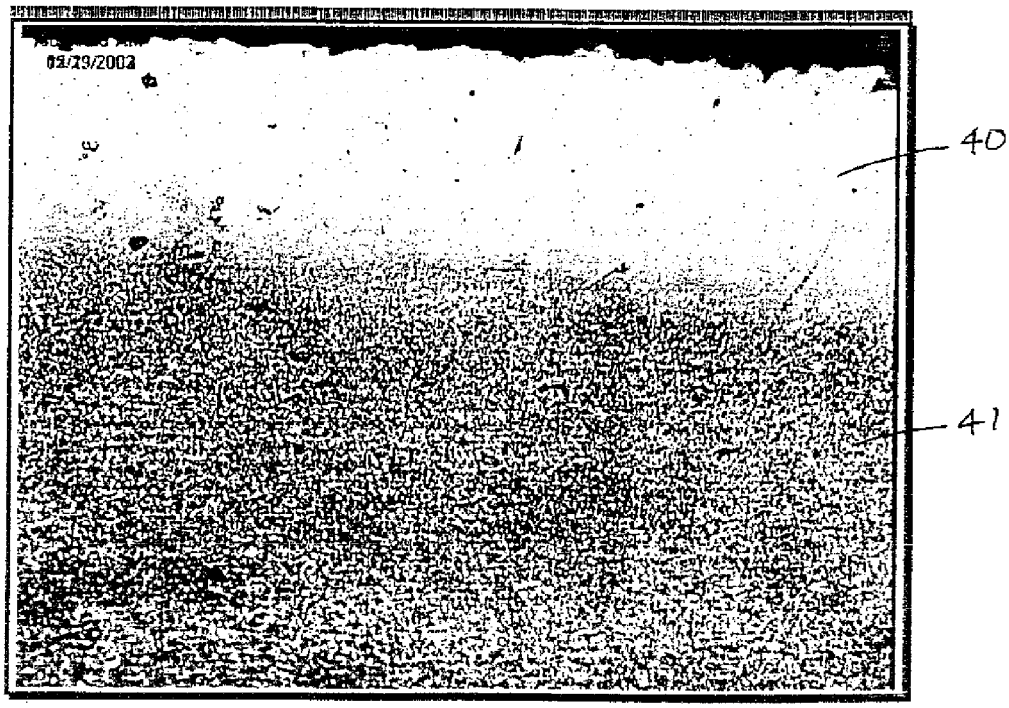
FIG. 7 is a micrograph illustrating the Pyrowear 675 carburized and hardened microstructure obtained using the nickel plating surface preparation prior to carburizing.
Figure 8:
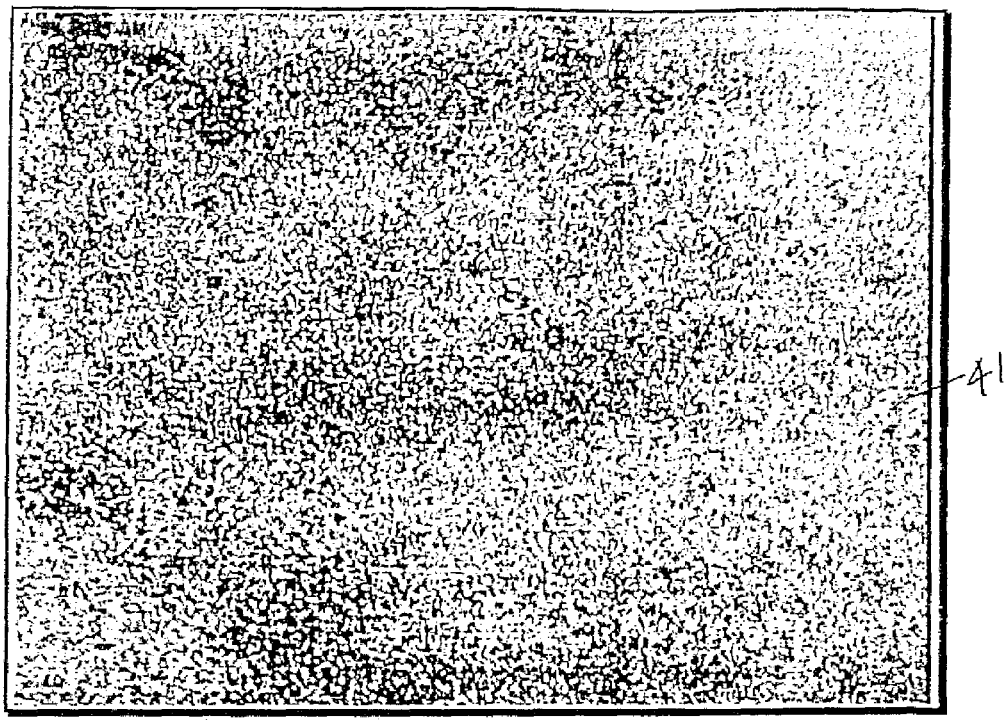
FIG. 8 is a micrograph illustrating the Pyrowear 675 carburized and hardened microstructure obtained using the nickel plating surface preparation prior to carburizing.
Figure 9:
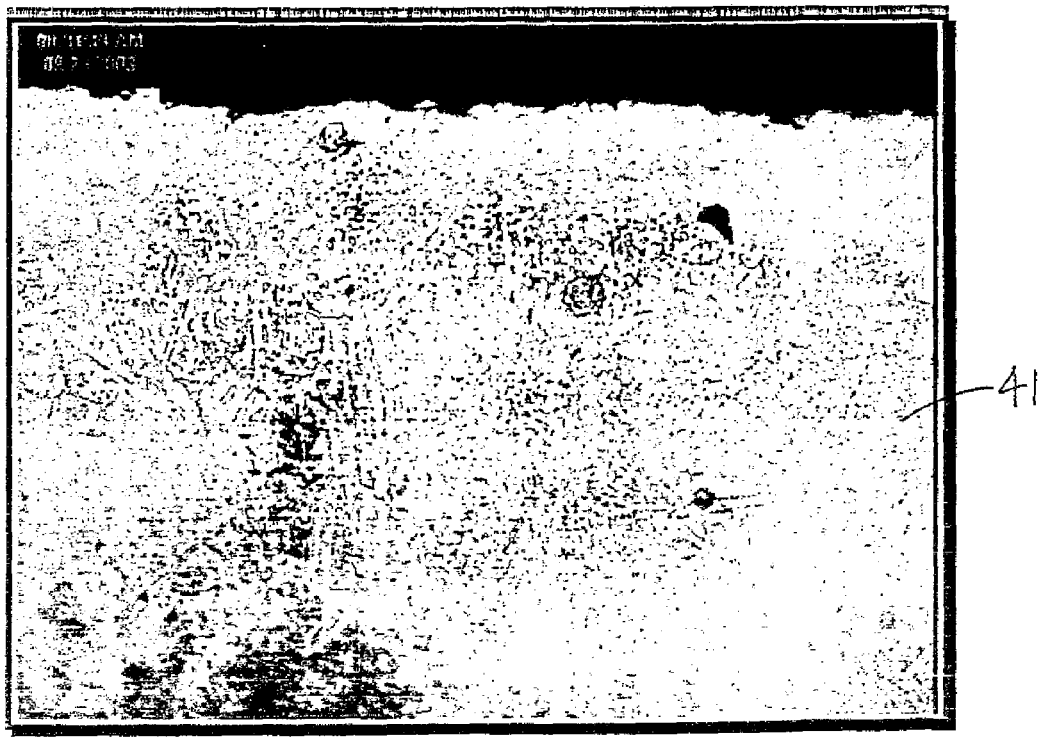
FIG. 9 is a micrograph illustrating the Pyrowear 675 carburized, hardened microstructure after annealing and grit blasted to remove the nickel plating.

With reference to FIGS. 7-9, there is illustrated moicrographs of the structure resulting from carburizing pyrowear 675 utilizing one form of the present invention. In FIG. 7, the nickel plating is present in region 40 and the carburized base material is represented in region 41. An enlarged version of region 41 is set forth in FIG. 8. Upon review of FIG. 8 the reader should note the fine uniformly dispersed carbides. With reference to FIG. 9, there is illustrated the carburized pyrowear 675 after being annealed and having the nickel plating stripped by grit blasting.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. It should be understood that while the use of the word preferable, preferably or preferred in the description above indicates that the feature so described may be more desirable, it nonetheless may not be necessary and embodiments lacking the same may be contemplated as within the scope of the invention, that scope being defined by the claims that follow. In reading the claims it is intended that when words such as "a," "an," "at least one," "at least a portion" are used there is no intention to limit the claim to only one item unless specifically stated to the contrary in the claim. Further, when the language "at least a portion" and/or "a portion" is used the item may include a portion and/or the entire item unless specifically stated to the contrary.

What is claimed:

1. A method, comprising:

providing a rolling element bearing comprising stainless steel;

applying an electroless nickel deposition alloy to the rolling element bearing, the electroless nickel deposition alloy comprising between 85 weight percent to 98 weight percent nickel and 15 weight percent to 2 weight percent phosphorous;

wherein the applying comprises positioning the rolling element bearing in a chemical nickel plating bath at a temperature between 185° F. and 190° F. and providing a deposit thickness of the electroless nickel deposition alloy between 0.0005 inches and 0.0015 inches; and heating the plated rolling element bearing to a carburizing temperature.

2. The method of claim 1, wherein the heating comprises heating the plated rolling element bearing to a temperature between 1600° F. and 1700° F.

3. The method of claim 1, wherein the electroless nickel deposition alloy further comprises between 4 weight percent and 2 weight percent phosphorous, and wherein the heating comprises heating the plated rolling element bearing to a temperature of at least 1650° F.

4. The method of claim 1, wherein the electroless nickel deposition alloy further comprises between 92 weight percent and 98 weight percent nickel, and between 8 weight percent and 2 weight percent phosphorous.

5. A method, comprising:

providing a rolling element bearing comprising stainless steel;

applying an electroless nickel deposition alloy to the rolling element bearing, the electroless nickel deposition alloy comprising between 85 weight percent to 98 weight percent nickel and 15 weight percent to 2 weight percent phosphorous;

wherein the applying comprises providing a deposit thickness of the electroless nickel deposition alloy between 0.0005 inches and 0.0015 inches;

heating the plated rolling element bearing to a carburizing temperature; and masking a portion of the rolling element bearing with a paraffin material before the applying.

6. A method, comprising:

providing a rolling element bearing comprising stainless steel;

applying an electroless nickel deposition alloy to the rolling element bearing, the electroless nickel deposition alloy comprising between 85 weight percent to 98 weight percent nickel and 15 weight percent to 2 weight percent phosphorous;

wherein the applying comprises providing a deposit thickness of the electroless nickel deposition alloy between 0.0005 inches and 0.0015 inches;

heating the plated rolling element bearing to a carburizing temperature; and wherein the heating the plated rolling element bearing to the carburizing temperature is performed in a furnace having a sub-atmospheric pressure.

7. A method, comprising:

providing a rolling element bearing comprising stainless steel;

applying an electroless nickel deposition alloy to the rolling element bearing, the electroless nickel deposition alloy comprising between 85 weight percent to 98 weight percent nickel and 15 weight percent to 2 weight percent phosphorous;

wherein the applying comprises providing a deposit thickness of the electroless nickel deposition alloy between 0.0005 inches and 0.0015 inches; and heating the plated rolling element bearing to a carburizing temperature; and performing the heating in a plurality of vacuum cycles in a furnace in the presence of a carburizing gas.

8. The method of claim 7, further comprising removing the carburizing gas from the furnace, and holding the rolling element bearing at the carburizing temperature after the heating for a passive diffusion time.

9. The method of claim 8, further comprising quenching the rolling element bearing.

10. The method of claim 9, further comprising annealing the rolling element bearing.

11. The method of claim 10, further comprising removing the nickel plating.

12. The method of claim 11, further comprising heating the rolling element bearing to a hardening temperature and further annealing the rolling element bearing after the heating the rolling element bearing to the hardening temperature.

13. The method of claim 12, wherein the hardening temperature comprises a temperature between 1800° F. and 1975° F.

14. The method of claim 13, further comprising repeating the heating the rolling element bearing to the hardening temperature and further annealing the rolling element bearing.

15. The method of claim 14, further comprising cooling the rolling element bearing to a temperature not warmer than −90° F. for not less than 2 hours.

16. The method of claim 15, further comprising heating the rolling element bearing in a circulating air furnace to a temperature between 575° F. and 625° F. for a time between 1 hour 45 minutes and 2 hours 15 minutes.

17. The method of claim 7, wherein each of the vacuum cycles comprises four minutes.

18. The method of claim 17, wherein the plurality of vacuum cycles comprises 520 vacuum cycles.

19. The method of claim 18, wherein the quenching comprises quenching the rolling element bearing in oil heated to 140° F.

* * * * *

UNITED STATES PATENT AND TRADEMARK OFFICE

CERTIFICATE OF CORRECTION

PATENT NO. : 8,293,028 B2
APPLICATION NO. : 12/689478
DATED : October 23, 2012
INVENTOR(S) : Hammond et al.

It is certified that error appears in the above-identified patent and that said Letters Patent is hereby corrected as shown below:

In the Specification

Column 2, line 42, replace “faun” with “form”

Signed and Sealed this
Ninth Day of September, 2014

Michelle K. Lee

Michelle K. Lee
*Deputy Director of the United States Patent and Trademark Office*